US006552499B2

(12) United States Patent
Derra et al.

(10) Patent No.: US 6,552,499 B2
(45) Date of Patent: Apr. 22, 2003

(54) HIGH-PRESSURE GAS DISCHARGE LAMP, AND METHOD OF MANUFACTURING SAME

(75) Inventors: Guenther Hans Derra, Aachen (DE); Hanns Ernst Fischer, Stolberg (DE); Dieter Leers, Stolberg (DE); Holger Moench, Vaals (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/015,853

(22) Filed: Dec. 10, 2001

(65) Prior Publication Data

US 2002/0117968 A1 Aug. 29, 2002

(30) Foreign Application Priority Data

Dec. 16, 2000 (DE) ..... 100 62 974

(51) Int. Cl.[7] ..... H05B 41/292; H05B 41/231
(52) U.S. Cl. ..... 315/291; 313/571
(58) Field of Search ..... 315/291, 94, 106, 315/112, 595; 313/631, 632, 491, 633, 634, 571, 285, 113, 217

(56) References Cited

U.S. PATENT DOCUMENTS 3,067,357 A 12/1962 Fridrich ..... 313/223
3,902,090 A * 8/1975 Ekkelboom et al. ..... 313/217
4,968,916 A * 11/1990 Davenport et al. ..... 313/571
5,905,339 A * 5/1999 Chow et al. ..... 313/631
5,949,192 A * 9/1999 Kominami et al. ..... 315/94
6,445,129 B1 * 9/2002 Seiler et al. ..... 313/594

FOREIGN PATENT DOCUMENTS

JP WO0036882 6/2000 ..... H05B/41/292
WO WO9535645 12/1995 ..... H05B/41/231
WO WO0036883 6/2000 ..... H05B/41/292

* cited by examiner

*Primary Examiner*—James Clinger
(74) *Attorney, Agent, or Firm*—Frank Keegan

(57) ABSTRACT

A high-pressure gas discharge lamp (HID or UHP lamp, or in general lamps with mercury fillings of between approximately 0.05 and 0.5 mg/mm$^3$) is described with at least one electrode (7, 8) which is provided with a thickened, for example globular portion (9, 10) at its end lying inside a lamp vessel (2). This portion is so dimensioned in dependence on operational parameters of the lamp and/or the diameter of the electrode rod that an electrode tip (19) forms itself independently at said portion during the first hours of operation. This tip grows from the portion until its free end starts melting. The electrode tip is self-adjusting in this manner, so that an optimum electrode interspacing is maintained throughout lamp life. Furthermore, a method of manufacturing such a lamp is described.

13 Claims, 3 Drawing Sheets

HIGH-PRESSURE GAS DISCHARGE LAMP, AND METHOD OF MANUFACTURING SAME

Figure 1:
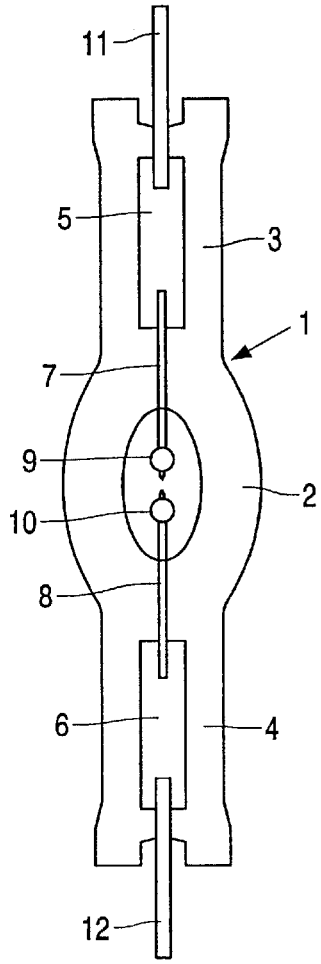

The invention relates to high-pressure gas discharge lamps (HID [high intensity discharge] lamps or UHP [ultra high performance] lamps), in particular to mercury high-pressure lamps with mercury fill quantities of between approximately 0.05 and 0.5 mg/mm$^3$, which comprise at least one electrode with an electrode rod, which rod is provided at its end with a thickened, for example globular electrode portion. The invention further relates to a lighting unit with such a high-pressure gas discharge lamp and to a power supply unit for supplying the lamp with operating parameters adapted thereto, as well as to a method of manufacturing the lamp.

The manufacture, the operating characteristics, the service life, and the cost of these lamps are determined to a substantial degree by the nature and shape of the electrodes which are used. Numerous geometric shapes of electrodes have accordingly been developed so as to take into account these criteria in various ways. In the simplest case, the lamp comprises two electrodes which are each formed by a tungsten rod. The free ends of the electrode rods extend into a lamp vessel with a gas atmosphere which renders possible the formation of a light arc in the operational state. The respective other ends are connected to connection pins for receiving an operating voltage via a lead-through extending through the lamp vessel.

The purpose being, for example, to improve the heat radiation of the electrodes and to avoid an excessive heating of the lead-through, and accordingly the risk of damage to the seal at the lamp vessel side at a high lamp power, a known solution is to provide one or several windings from the same material as the electrode at the respective free ends of the electrodes. These windings may possibly be fused to the electrode rod, in particular for achieving the function of a heat buffer in AC-operated lamps. The service life of the electrodes can also be prolonged thereby. Electrodes of this kind can be manufactured comparatively easily from tungsten and are generally known.

An intrinsic disadvantage of these electrodes is, however, that the thermal conductance is usually comparatively low and not reproducible, because the thermal contact between the windings and the rod as well as between individual turns may change during lamp life. These effects may cause changes in the lamp characteristics, i.e. the optical output power and the required operating voltage by up to 30%, in particular in the case of lamps having a short light arc (for example approximately 1 mm). These problems occur substantially independently of whether the windings are fused to the electrode or not, also in the short-arc lamps (for example UHP lamps), because these lamps are operated at such high temperatures (above 3000 K) that also the fused portions are liable to change. Electrodes formed from a suitably strong, solid tungsten rod for the purpose of avoiding this problem are expensive and complicated to manufacture.

An electrode is known from U.S. Pat. No. 3,067,357 in which a tungsten rod has a globular portion created by melting at its free end. The heat required for the melting may be generated during manufacture or during operation of the lamp, the dimensions of said portion, and thus also the electrode spacing, being determined by the lamp current, the pressure inside the lamp, and the diameter of the electrode rod. During operation, a certain proportion (50%) of this portion must always be in the molten state. The manufacture of the electrode should become substantially simpler and less expensive in this manner, because the dimensions of the globular portion, from which the light arc departs, is achieved through a suitable adjustment of said quantities and not through manufacturing and assembling processes which are comparatively sensitive to tolerances, complicated, and expensive.

An essential disadvantage of this lamp is, however, that the lamp current must be adjusted very accurately and must be kept very constant so as to generate the globular portion and to keep it in the molten state in the required proportion. A current which is only a few percents higher may have the result that the entire portion and part of the rod of the electrode melts, so that said portion becomes larger and the distance to the opposite electrode is considerably and permanently changed. This effect is so strong in the case of short light arcs that the current limits must be observed very accurately so as to be able to operate a short-arc lamp with this kind of electrodes in a stable manner. Added to this is that these current limits change during the switch-on phase in dependence on the rising pressure of the gas vapor inside the lamp.

A further disadvantage of this lamp is that the electrode distance increases during lamp life. This is caused basically by the fact that the free iodine atmosphere, by means of which a blackening of the walls is to be prevented, accelerates the transport of tungsten from the hot electrode tip to the rear portions of the electrode. This disadvantage, again, influences short-arc lamps particularly strongly to the extent that they have a maximum life of only a few hundred hours with these electrodes.

It was finally demonstrated that the light arc may periodically move over the front surface of the electrode, in particular in mercury high-pressure lamps (UHP lamps with a pressure of approximately 200 bar) with such an electrode, so that the use of these lamps in projection systems is not possible.

It is accordingly an object of the invention to provide a high-pressure gas discharge lamp of the kind mentioned in the opening paragraph and a lighting unit with such a lamp which during their total operational life provide a stable operation free from fluctuations in combination with a substantially permanent electrode distance, without special requirements having to be imposed on the accuracy and constancy of the lamp current for this.

A further object of the invention is to provide a method whereby such a high-pressure gas discharge lamp can be manufactured in a particularly simple and inexpensive manner.

The former object is achieved according to claim 1, on the one hand, by means of a high-pressure gas discharge lamp of the kind mentioned in the opening paragraph which is characterized in that the thickened electrode portion is dimensioned in dependence on operational parameters of the lamp such that said thickened portion does not melt during normal lamp operation, but that an electrode tip forms itself at the electrode portion during the first hours of operation of the lamp until said tip melts in the region of the point of application of a light arc.

On the other hand, the latter object is achieved according to claim 10 by means of a lighting unit with a high-pressure gas discharge lamp of this kind as well as with a power supply unit for supplying the lamp with operational parameters adapted thereto such that the thickened electrode portion does not melt during normal lamp operation, but that an electrode tip forms itself at the electrode portion during the first hours of operation of the lamp until said tip melts in the region of the point of application of a light arc.

The operational parameters mentioned above are in particular the level of the operating voltage and of the operating current as well as the gradients thereof in time and their frequencies.

The invention is based on the surprising recognition that the electrode tip builds itself up during the first hours of operation of a lamp having such an electrode, which process ends automatically the moment the tip at the end of the electrode starts melting.

A particular advantage of this solution is accordingly that the electrode tip is self-stabilizing as regards its length. A complicated optimization of the electrode spacing is made redundant thereby.

In addition, this self-stabilizing effect remains intact throughout the entire lamp life, so that an optimum electrode distance is present at all times. This advantage is of particular importance for short-arc lamps because the electrodes are highly loaded in these lamps. Furthermore, the lamp is particularly suitable for projection applications because of its stable light arc.

It is true that the electrode tip is molten in the region where the light arc makes contact. However, since the thickened portion has a substantially greater mass as compared with the tip and thus acts as a heat buffer or a heat radiator, the remaining portion of the electrode has substantially lower temperatures, with the result that the lamp has a very long useful life.

To achieve the second object mentioned above, according to claim 7, a method of manufacturing a high-pressure gas discharge lamp is provided which is characterized in that, for the manufacture of the electrode, an electrode rod is provided with a thickened portion at one end, and an electrode tip is formed at this portion during the first hours of operation of the lamp by means of a current which corresponds substantially to the operational current of the lamp, during which the thickened portion is dimensioned in dependence on said current.

The essential advantage of this method is that it is particularly simple and inexpensive, because the usually very complicated manufacture of the electrodes becomes largely redundant, i.e. is limited to the manufacture of the thickened portion at the electrode rod.

The dependent claims relate to advantageous further embodiments of the invention.

The dimensions in accordance with claims 2 and 3 were found to be particularly advantageous for a well-defined formation of the electrode tips.

The embodiments in accordance with claims 4 and 5 have particular advantages as regards the luminous efficacy and the prevention of darkening of the lamp vessel during lamp life.

Figure 2A:
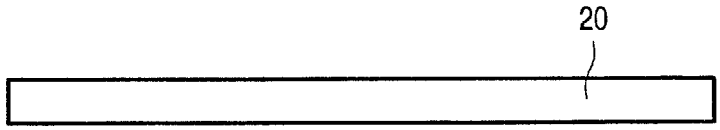
Figure 2B:
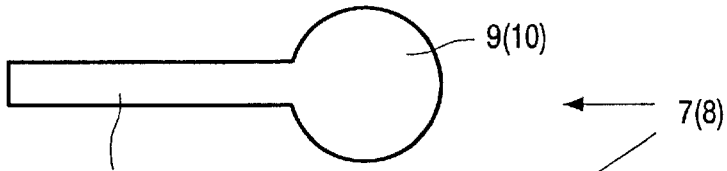
Figure 2C:
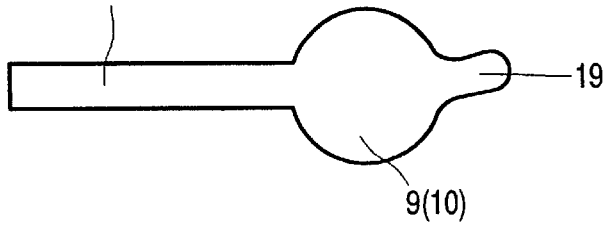
Figure 3:
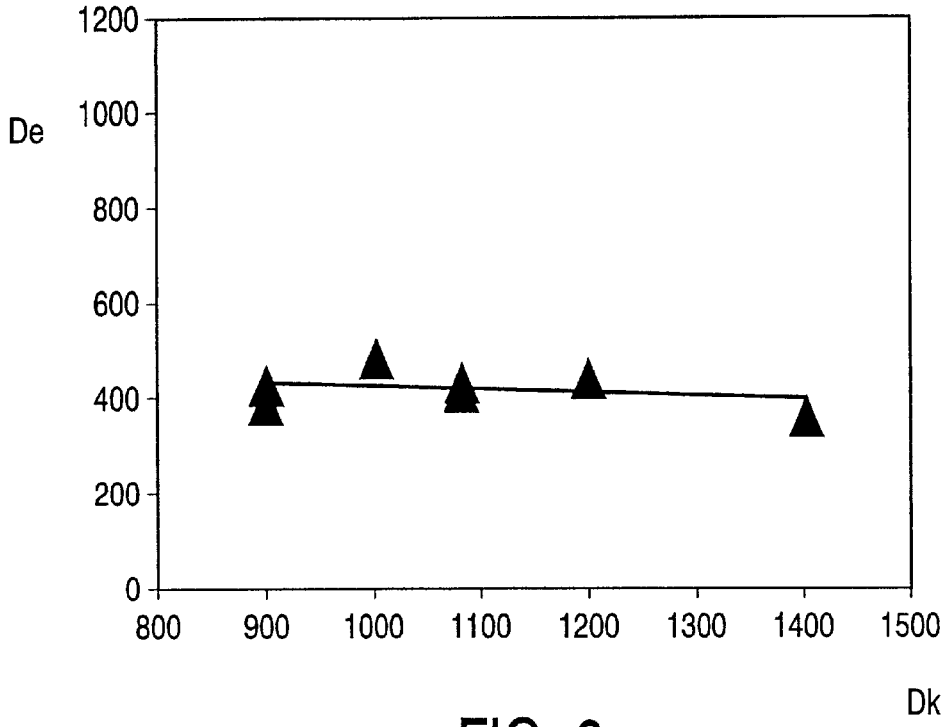
Figure 4:
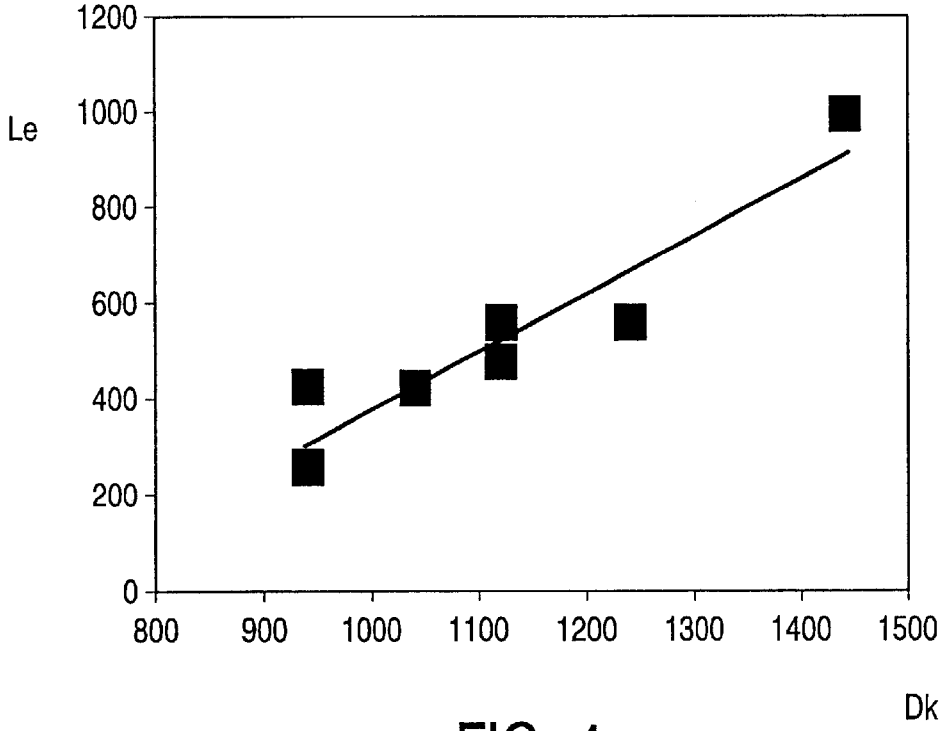
Figure 5:
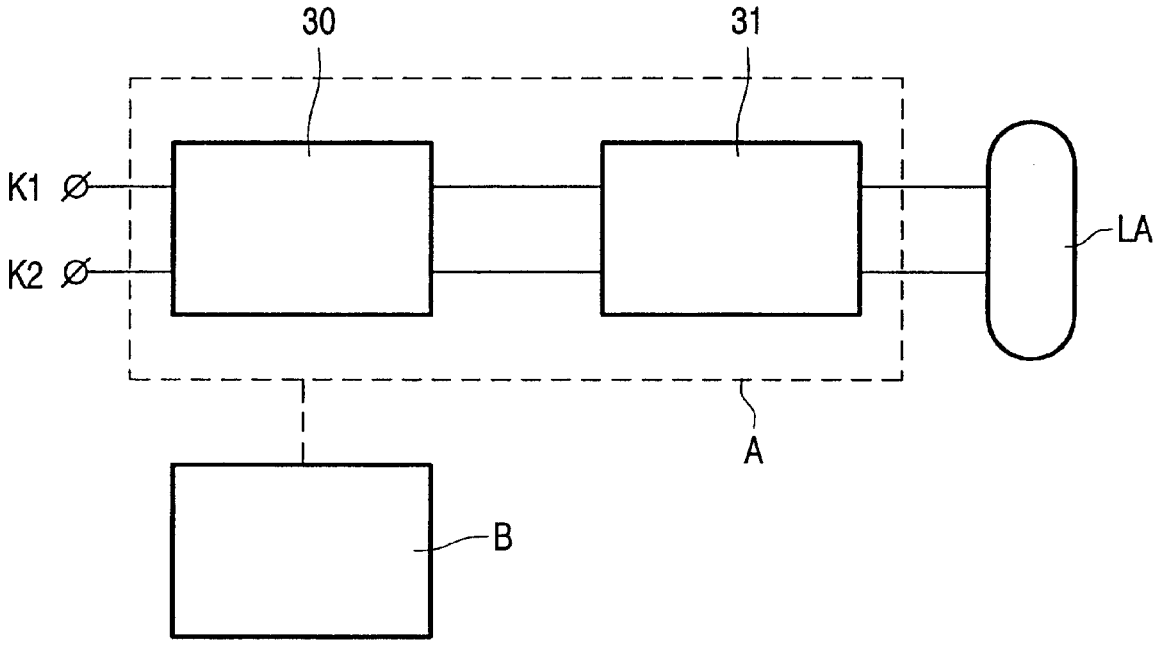

Further particulars, characteristics, and advantages of the invention will become apparent from the ensuing description of a preferred embodiment which is given with reference to the drawing, in which:

FIG. 1 is a diagrammatic general view of a lamp according to the invention,

FIGS. 2(*a*) to (*c*) show several phases in the creation of an electrode;

FIG. 3 plots the relationship between the diameter of the electrode tip being created and the diameter of a globular electrode portion;

FIG. 4 shows a relation between the length of the electrode tips being created and the diameter of a globular electrode portion; and FIG. 5 shows a power supply unit for a lamp according to the invention.

The operational parameters of the lamp described below, i.e. the levels of the operational voltages and currents as well as their gradients in time and frequencies relate both to the generation of the electrode tip during the first hours of operation of the lamp and to the subsequent normal operation in the desired application. Therefore, the lamp is preferably combined with a power supply unit by means of which a generally available mains voltage is converted into said operational voltage for the lamp having said properties. Power supply units of this kind are disclosed, for example, in WO 95/35645, WO 00/36882, and WO 00/36883, which are deemed to be included in the present publication by reference.

FIG. 1 shows by way of example a short-arc high-pressure gas discharge lamp 1 which has an elliptical lamp vessel 2 of quartz glass or a ceramic material with a light emission window. The gas inside the vessel is mercury vapor to which approximately 0.001 to 10 $\mu$mole/cm$^3$ bromine (or chlorine) was added such that a regenerative tungsten cycle can be generated. In conjunction with the oxygen present in the bulb 2, it is prevented at the same time that the walls of the vessel become darker during lamp operation.

The first ends of a first and a second electrode 7, 8 made of tungsten extend into the lamp vessel 2. These ends each comprise a substantially globular electrode portion 9, 10, whereas the other ends of the electrodes are connected to respective electrically conducting foils 5, 6, for example made of molybdenum. The vessel 2 extends longitudinally in the form of cylindrical quartz portions 3, 4 into which the foils 5 and 6 are enclosed in a vacuumtight manner. Connection pins 11, 12, through which the lamp current is supplied, are connected in their turn to the foils and extend to the exterior.

FIG. 2 shows one of the electrodes 7, 8 in several phases of its creation on an enlarged scale. The processes and procedures described by way of example below with reference to the electrode 7 also apply to the other electrode 8 in the case of AC operation of the lamp.

The manufacture starts, cf. FIG. 2(*a*), with an electrode rod 20 of tungsten with a diameter of approximately 0.4 mm. An electrode portion 9, spherical in shape in the simplest case, with a diameter of approximately 0.8 to 1.7 mm is formed at the first end of this rod. These dimensions relate to lamp currents of approximately 1.5 to 2.5 A, whereas other dimensions may be suitable for other currents. A generally suitable range was found to be a rod diameter of between 0.2 and 0.7 mm and a diameter of the globular portion of between 0.5 and 3.0 mm in the case of a lamp current of between approximately 0.5 and 8 A (UHP lamp of 50–500 W). It is in general advantageous here if the diameter of the globular portion is approximately 1.5 to 5 times the diameter of the rod.

The globular portion 9 may be created through fusion at the one end of the rod 20 or in a different manner such as, for example, by mechanical upsetting of a preheated tungsten wire, such that the electrode 7 shown in FIG. 2(*b*) is formed. Instead of a spherical shape, alternative shapes resembling a globule are also possible such as, for example, conical portions or other "thickenings", flatter portions being chosen in particular for higher frequencies of the lamp operating voltage.

The lamp of FIG. 1 is subsequently manufactured with two electrodes 7, 8 of this type. The comparatively great diameter of the globular portion 9, (10) in relation to the diameter of the rod 20 has the result that said portion does not heat up so strongly during lamp operation as is the case with conventional electrode tips. This has the advantage inter alia that the tungsten transport from the tip towards the rear portions of the electrode is substantially less than with the known electrodes described in the opening paragraph.

It was surprisingly found, moreover, that the globular portion of FIG. 2(*c*) changes within the first hours of operation of the lamp. Again, this is true for both electrodes 7 (8) in the case of AC operation. An electrode tip 19 forms itself then at the area where the light arc applies itself, such that the globular portion 9 (10) is given a corresponding flattening in this region.

The shape with which the electrode tip 19 builds itself up may be influenced in the first place by the size of the thickened portion and the frequency of the lamp current.

It was found in particular in this respect for a globular portion 9 (10) that the thickness of the electrode tip, i.e. its diameter De, is determined in the first place by the frequency f and is substantially independent of the diameter Dk of the portion 9 (10). These interrelationships are shown in the diagram of FIG. 3, where the diameter De [$\mu$m] of the developing electrode tip 19 (triangle symbols) is plotted as a function of various diameters Dk [$\mu$m] of the globular portion 9 (10) for an electrode rod having a diameter of 400 $\mu$m.

The lamps were operated here with a power of 120 W at approximately 80 V with a lamp current having a frequency f of 90 Hz. A current pulse of the same polarity was then superimposed on a predetermined number of half cycles, preferably each half cycle of the lamp current, i.e. of the same polarity as the relevant cycle. The ratio between the average amplitude of the current pulse and the average amplitude of the lamp current may lie between 0.6 and 2, and the ratio between the duration of the current pulse and a half cycle of the lamp current may lie between 0.05 and 0.15. A further dimensioning rule was found to be that the proportion of the power supplied to the lamp by the current pulse preferably amounts to between 5 and 15 percents of the power which is supplied to the lamp during a half cycle by means of the lamp current.

A circuit for generating such a lamp current will be explained in more detail below with reference to FIG. 5, and is disclosed in detail in WO 95/35645.

At an operating frequency f of 90 Hz, the tip accordingly has a diameter which resembles that of the electrode rod. A general relation found for the diameter De of the electrode tip was found to be: $De=a/\subseteq f$, with a being a proportionality constant specific for the lamp, lying in a range from 2000 to 10,000 (in this case approximately 4000) $\mu mHz^{0.5}$.

In contrast thereto, the length Le of the developing electrode tip 19 is dependent on the diameter Dk of the globular portion 9 (10). This relationship is shown in FIG. 4, in which the length Le of the electrode tip (rectangular symbols) is plotted as a function of various diameters Dk of the portion 9 (10) for a diameter of the electrode rod of 400 $\mu$m. The lamps were again operated with a power of 120 W at approximately 80 V with an operating current having a frequency f of 90 Hz and a current waveform in accordance with the description given for FIG. 3.

The length Le of the electrode tip 19 is indeed also clearly dependent on the lamp current and the lamp power. The higher these two values, the shorter the tip 19 which arises. The lamp current and the lamp power determine the total energy input into the electrodes, while the size of the globular portion 9 (10) again influences the energy radiation. The size of this portion is chosen for the practical application such that a long lamp life is obtained.

The number of the first hours of operation during which the electrode tip 19 is formed lies at approximately one hour for a tip length of approximately 200 $\mu$m and at approximately 50 hours for a tip length of approximately 1 mm.

The interrelationships discussed above are also valid if a shape of the thickening other than the globular shape is chosen for the portion.

The tip 19 gradually increases in size during its creation until its front end becomes so hot that it melts. Once the front end has become molten, no further growth can be observed. If in accordance with the interrelationships discussed above the operational parameters are adjusted such that the tip 19 reaches a length of approximately 0.1 to 1.0 mm, therefore, the final electrode distance will be approximately 0.2 to 2.0 mm shorter after completion of the first hours of operation than the spacing between the globular portions 9 and 10 before the lamp is switched on for the first time.

An electrode shape accordingly arises which is formed by a comparatively thin electrode rod 20, a comparatively bulky, globular electrode portion 9 (10), and a thin electrode tip 19. The portion 9 (10) is so dimensioned here that it has a good thermal radiation characteristic and is sufficiently cold for achieving a reliable and stable operation of the lamp over several thousands of hours. The electrode tip 19 created during operation has a molten region at its front end which is small enough to safeguard a stable point of application of the light arc. This is true in particular for high-pressure UHP lamps. Experiments have shown that the stability of the light arc is substantially better throughout lamp life than in the case of known electrode shapes.

This electrode according to the invention is also capable of solving those problems which arise from mounting and from tolerances in the lateral distance of electrodes. The globular portion here renders possible first of all the formation of a horizontal light arc. The tips then grow again at the points of application of the light arc during operation of the lamp in the first hours of operation until the front ends have become molten. Since this is dependent on their mutual distance, lateral tolerances are eliminated.

Instead of the electrode shown in FIG. 2(*b*), an electrode may alternatively be used which already comprises a previously formed tip. The comparatively large voltage changes as well as the reduction in the electrode interspacing occurring during the first hours of operation are considerably reduced thereby. For this purpose, the previously formed tip should have dimensions similar to those which will arise automatically during subsequent normal operation.

The manufacture of the electrode may alternatively be carried out in that one or several windings are provided on an end of a rod as shown in FIG. 2(*a*), the windings consisting, for example, of the same material as the rod. The globular or similar portion ("thickening") may then be created through a full or partial fusion of this region of the rod provided with the windings in a comparatively simple manner.

The use of the electrodes according to the invention is not limited to short-arc lamps, although they do have particular advantages therein because of the high load on the electrodes in such lamps as well as the self-adjusting, very small distances between the electrodes.

The formation of the electrode tip is dependent on the lamp current in proportion to the size, i.e. the thermal radiation power of the globular portion, and thus on the temperature arising there. This temperature should indeed be as high as possible, but not so high that the portion melts. An electrode dimensioning which is suitable, indeed an optimum for practically all lamp powers may be found through a suitable adjustment and mutual attuning of these operational parameters and of the parameters mentioned further above.

A power supply unit which converts a general mains voltage into a supply voltage for the lamp is preferably provided for operating the lamp with the operational parameters described. Such a (switch mode) power supply unit is shown in FIG. 5 by way of example. The mains voltage in this case is assumed to be an AC voltage which is applied to input terminals K1, K2 of the power supply unit. The power supply unit comprises a switching unit A by means of which the mains voltage is converted into an AC voltage for the lamp LA. For this purpose, a first device 30 for converting the mains voltage into a DC voltage and a commutator 31 for converting the DC voltage into the AC voltage for the lamp are provided.

The power supply unit furthermore comprises a control unit B by means of which the switching unit A is triggered such that, for example, a programmable number of half cycles, or every half cycle of the lamp current is superimposed with an additional current pulse of the same polarity as the relevant cycle. This results in a correspondingly increased lamp current in its time gradient, as was described above with reference to FIG. 3 and by means of which a particularly stable operation without arc instabilities can be achieved. A suitable circuit for such a control unit is disclosed in WO 95/35645.

Alternatively, the control unit B may also serve to reduce the lamp current at the start of a half cycle relative to an average current during normal operation, whereby a particularly stable and diffuse application of the light arc is achieved for certain electrodes. Such a control unit is described in WO 00/36883.

Finally, the control unit B may also influence the lamp current in dependence on certain operational states or requirements, which are detected by corresponding sensor means, such as, for example, the temperature, or the current flowing through the lamp, or the intensity and fluctuations of the generated light. A control unit suitable for this is disclosed in WO 00/36882.

The other operational parameters mentioned above such as, for example, the frequency of the lamp voltage, may also be optimally adapted to the lamp type or to certain operational conditions by means of such a power supply unit. Preferably, therefore, the power supply unit is combined with a lamp so as to form a lighting unit which is optimized for a certain application such as, for example, for projection purposes.

What is claimed is:

1. A high-pressure gas discharge lamp with at least one electrode having an electrode rod which comprises a thickened electrode portion at one end, characterized in that the thickened electrode portion (9, 10) is dimensioned in dependence on operational parameters of the lamp such that said thickened portion does not melt during normal lamp operation, but that an electrode tip (19) forms itself at the electrode portion (9, 10) during the first hours of operation of the lamp until said tip (19) melts in the region of the point of application of a light arc.

2. A high-pressure gas discharge lamp as claimed in claim 1, characterized in that the electrode portion (9, 10) is globular in shape and has a diameter which is approximately 1.5 to 5 times greater than the diameter of the electrode rod (20).

3. A high-pressure gas discharge lamp as claimed in claim 1, characterized in that the electrode portion (9, 10) is globular in shape and has a diameter of approximately 0.5 to 3.0 mm for a lamp current of approximately 0.5 to 8 A.

4. A high-pressure gas discharge lamp as claimed in claim 1, characterized in that the at least one electrode (7, 8) is made of tungsten and in that the gas is mercury vapor, to which oxygen and bromine or chlorine have been added for generating a regenerative tungsten cycle.

5. A high-pressure gas discharge lamp as claimed in claim 4, characterized in that the bromine is added in a quantity of approximately 0.001 to 10 $\mu$mole/cm$^3$.

6. A high-pressure gas discharge lamp as claimed in claim 1, characterized in that the formation of the electrode tip (19) can be influenced by the lamp current in proportion to the dimensions of the electrode rod (20) and the electrode portion (9, 10).

7. A method of manufacturing a high-pressure gas discharge lamp, characterized in that, for the manufacture of the electrode, an electrode rod is provided with a thickened portion (9, 10) at one end, and an electrode tip (19) is formed at this portion (9, 10) during the first hours of operation of the lamp by means of a current which corresponds substantially to the operational current of the lamp, during which the thickened portion is dimensioned in dependence on said current.

8. A method as claimed in claim 7, characterized in that the thickened portion (9, 10) is created through the application of at least one winding on the electrode and a subsequent full or partial fusion of the windings with the electrode material.

9. A method as claimed in claim 7, characterized in that an electrode tip is preformed at the thickened portion (9, 10), from which tip the final shape of the tip creates itself during the first hours of operation of the lamp.

10. A lighting unit with a high-pressure gas discharge lamp as claimed in claim 1, as well as a switch mode power supply unit for supplying the lamp with operational parameters adapted thereto such that the thickened electrode portion (9, 10) does not melt during normal lamp operation, but that an electrode tip (19) forms itself at the electrode portion (9, 10) during the first hours of operation of the lamp until said tip (19) melts in the region of the point of application of a light arc.

11. A lighting unit as claimed in claim 10, characterized in that the switch mode power supply unit comprises a control unit (B) by means of which a programmable number of half cycles of the lamp current can be superimposed with an additional current pulse of the same polarity.

12. A lighting unit as claimed in claim 10, characterized in that the switch mode power supply unit comprises a control unit (B) by means of which the lamp current can be reduced at the start of a half cycle relative to an average current during normal operation.

13. A lighting unit as claimed in claim 10, characterized in that the switch mode power supply unit comprises a control unit (B) as well as sensor means for detecting operational states of the lamp, such that the operational parameters can be changed by the control unit in dependence on a detected operational state for obtaining a stable lamp operation.

* * * * *